United States Patent [19]

Busi

[11] 4,297,857

[45] Nov. 3, 1981

[54] APPARATUS FOR KNITTING TERRY LOOPS ON A CIRCULAR HOSIERY MACHINE

[76] Inventor: Giovanni Busi, via Tito Speri 116, Botticino Sera, Brescia, Italy

[21] Appl. No.: 61,897

[22] Filed: Jul. 30, 1979

[30] Foreign Application Priority Data

May 2, 1978 [IT] Italy ..... 5181 A/78

[51] Int. Cl.[3] ..... D04B 9/12

[52] U.S. Cl. ..... 66/9 R; 66/91

[58] Field of Search ..... 66/9 R, 10, 11, 12, 66/90, 91, 92, 93, 8 (U.S. only)

[56] References Cited

U.S. PATENT DOCUMENTS

| | | | |
|---|---|---|---|
| 2,450,376 | 9/1948 | Holmes | 66/91 X |
| 3,007,325 | 11/1961 | Smith | 66/90 |
| 3,013,414 | 12/1961 | Minton | 66/9 R |
| 3,934,431 | 1/1976 | Westmoreland, Sr. | 66/90 X |
| 3,964,275 | 6/1976 | Busi et al. | 66/91 |

FOREIGN PATENT DOCUMENTS

| | | | |
|---|---|---|---|
| 493607 | 3/1930 | Fed. Rep. of Germany | 66/90 |
| 2322384 | 11/1974 | Fed. Rep. of Germany | 66/92 |
| 59900 | 1/1968 | German Democratic Rep. | 66/91 |

*Primary Examiner*—Wm. Carter Reynolds

[57] ABSTRACT

Apparatus is disclosed for knitting terry loops on a circular hosiery machine having at least one feeding station. The apparatus includes a cylinder that carries a plurality of needles individually guided in a groove provided on the cylinder. The needles are engaged and vertically displaced by stationary cams. A plurality of radial sinkers cooperate with the needles and at least two yarns are concurrently fed to the needles at one or more working stations. A sleeve is positioned in the needle clyinder and a plurality of longitudinal, radial grooves are formed through the wall of the cylinder for guiding an equal number of pin punches which are alternately positioned with the needles of the cylinder. Each pin punch has a butt that is guided in a cam track inside said sleeve. The pin punches are moved upwardly to form the terry loop of the fabric with at least one of the fed yarns, while the needles of the cylinder are depressed to knit the base fabric.

12 Claims, 7 Drawing Figures

APPARATUS FOR KNITTING TERRY LOOPS ON A CIRCULAR HOSIERY MACHINE

The present invention relates generally to apparatus for manufacturing a terry loop fabric on a circular hosiery machine having one or more feeding stations and more particularly to apparatus suitable to manufacture the so-called "Vanisé"—type fabric, by simultaneously feeding at least two threads of different type or color to the machine.

According to conventional and known knitting techniques, the knitting of terry loops on circular hosiery machines and the like is carried out by various procedures such as by using at least two concurrently fed threads during the knitting. One of the threads is conventionally introduced into the machine by the needles, so as to make the so-called base fabric, while the other thread is engaged by pin punches, sinkers or equivalent elements which are appropriately positioned, so as to make the so-called terry loops. The two types of stitching are then connected to each other with the looped stitch protruding from one side of the resulting fabric.

However, to make a terry type fabric by means of known methods and by employing conventional devices such as those heretofore in use, there are certain serious disadvantages and operational difficulties, especially in fabrics manufactured with a rotational, reciprocating motion of the cylinder of the circular machine.

The same drawback is faced in knitting the so-called "Vanisé" type fabric, because it is not possible with the conventionally used apparatus to achieve a correct positioning of the threads on both sides of the fabric, so as to yield a satisfactory product, both aesthetically and qualitatively.

It is, therefore, an object of the present invention to provide an apparatus which permits the knitting of terry loop fabrics both when using a continuous rotational motion and a reciprocating rotational motion of the cylinder and wherein the knitting occurs either on the entire fabric or on predetermined portions thereof, inclusive of the sack-like heel, the sole, etc. of the hosiery.

It is another object of the invention to allow the knitting of a terry loop fabric which is more regular and having a knitting that has a correct positioning of the multiple threads concurrently employed.

Still another object is to provide an apparatus that also permits the knitting of the so-called "Vanisé" type fabric, with results that are superior to those heretofore achieved, and without adjustments in the feeding operations.

These and other objects are obtained with the apparatus of the present invention, which comprises a selectively rotating cylinder of either the continuous rotational or of the reciprocating rotational type. The selectively rotating cylinder carries a plurality of needles that are individually guided within grooves provided on the cylinder. The needles are engaged by their respective cams for their operational displacements. A sinker bed encircles the cylinder and carries a plurality of radial sinkers which cooperate with the above-mentioned needles in the knitting process. Feeding means or stations concurrently supply the needles with at least two yarns. The apparatus of the present invention is characterized by a sleeve positioned within the cylinder and having a plurality of longitudinal grooves, placed radially and guiding an equal number of pin punches. These punches have a V-shaped upper head and are positioned so as to be alternately aligned with the needles of the cylinder. Each pin punch has a butt that is turned and which protrudes toward the center of the sleeve. Other cams are positioned inside the sleeve and define a guide path for the butts of the punches during their vertical, up-and-down displacement. The punches are moved upwardly, when knitting the looped stitches (forming the terry portion of the fabric), with at least one of the fed yarns; concurrently, the needles of the cylinder move downwardly for knitting the base of the fabric (forming the smooth portion thereof). The second-mentioned cams may be positioned vertically so as to activate or deactivate the pin punches.

According to another particular feature of the invention, the internal region of the cylinder, which region is to receive the sleeve and pin punches, is countersunk or tapered inwardly from top to bottom so as to allow a rocking motion of the punches in their respective grooves, when the beating sinkers, during their displacement toward the inside of the cylinder, push the old stitches so as to assist in the correct descent of the pin punches and in the dropping of the terry loops formed thereby.

Greater details of the invention will become evident from the following description thereof and from the accompanying drawings which are merely illustrative of the invention and not limitative thereof, and in which.

Figure 3:
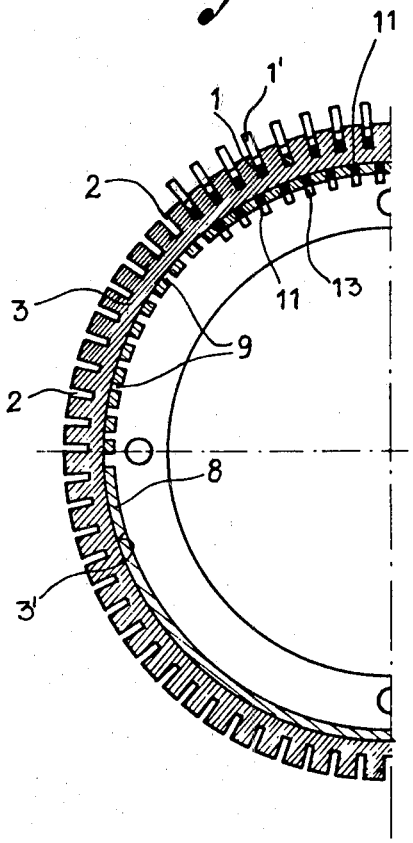
FIG. 3 is a transverse sectional view taken in the direction of arrows 3—3 of FIG. 2.

Referring now to the accompanying drawings, a plurality of needles 1 are individually mounted in a corresponding groove or channel 2 provided on the cylinder 3 of the circular knitting machine as shown best in FIG. 3. The needles 1 move axially with respect to the cylinder 3 and cooperate, in a known and conventional manner, with a plurality of radially positioned sinkers 4 (FIG. 7) which are positioned on an annular sinker bed 5 that encircles the cylinder 3. The sinkers 4 are movable radially and are guided from the outside for displacement toward the center of the cylinder 3.

The needles 1 of the cylinder 3 have heels or butts 1' which are engaged by stitch cams (not shown) mounted on a stitch cam support or ring that surrounds the cylinder 3. The cams that engage the butts 1' provide for the vertical movements of the needles as a result of the rotation of cylinder 3. The cylinder 3 is so actuated as to rotate either with a continuous rotational motion or with a reciprocating rotational motion, depending on the portion of hosiery being knitted. The rotation of the cylinder 3 occurs while the needles 1 of the cylinder 3 are fed by one or more feeding stations with at least two yarns a and b that are fed concurrently by means of suitable yarn fingers 6–7 (see FIG. 1). One of the yarns (a) forms the base stitches of the fabric and the other yarn (b) helps in the formation of the protruding terry loops of the fabric.

In accordance with the invention, in the upper, inner part of the cylinder 3 there is a wall 3' on which there is positioned and held in place a sleeve 8 which has as many longitudinal, axially arranged grooves 9 (angularly spaced from one another) as there are grooves 2 in the cylinder 3 for guiding the needles 1. This is so even if in particular knitting operations the grooves 9 may be provided only on one half of the circumference of the sleeve 8. The sleeve 8 is held inside cylinder 3 by any suitable means to rotate together therewith and in such a manner that the longitudinal grooves 9 thereof are positioned in the spaces intermediate each two adjoining grooves 2 for the needles 1 as shown in detail in FIG. 3 of the accompanying drawings. Furthermore, the grooves 9 extend through the entire thickness of the sleeve 8 so as to be open or, in other words, to radially pass toward the inside. In their upper region, these grooves 9 coincide with radial comb-like throats 10 that are coplanar with the sinker bed 5 of the sinkers 4 and serve the purpose of guiding the sinkers 4 when the latter move toward the center of the cylinder 3.

Figure 5:
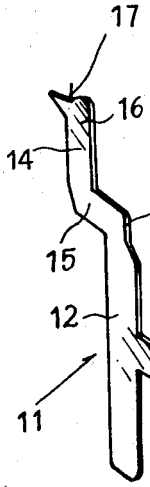
FIG. 5 is a perspective view illustrating a pin punch for knitting terry loops.

In each longitudinal groove 9 of the sleeve 8 (associated with the cylinder 3) there is positioned a pin punch 11 of the type shown in FIG. 5 and which cooperates with the needles 1 for the knitting of the terry fabric. Each punch 11 comprises a rectilinear stem 12 having a longitudinal axis. Each punch 11 guided in its respective groove 9 of the sleeve 8 and includes a butt 13 that faces and protrudes toward the center of the sleeve 8 or of the cylinder 3 and an upper portion 14 that is integral with the stem 12 by means of a transverse portion 15 that is radially displaced outwardly in the direction opposite to the butt 13 which is located intermediate the transverse portion 15 and the end of the stem 12 which is remote from the upper portion 14. Thus the portion 14 is positioned on the same circumferential line as the needles 1 of the cylinder 3. Each punch 11 is also provided with an upper head 16 having a recess 17 for collecting and supporting the yarn b or, in any event, those yarns which serve the purpose of knitting the terry loops.

Figure 1:
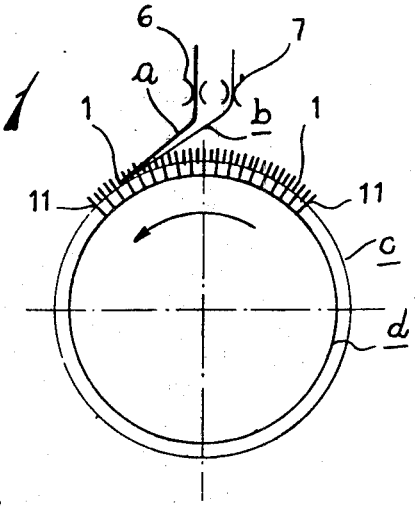
FIG. 1 is a schematic plan view of a cylinder with needles and pin punches positioned alternately to one another, and with a two-yarn feeding station for the knitting of a terry loop fabric.
Figure 4:
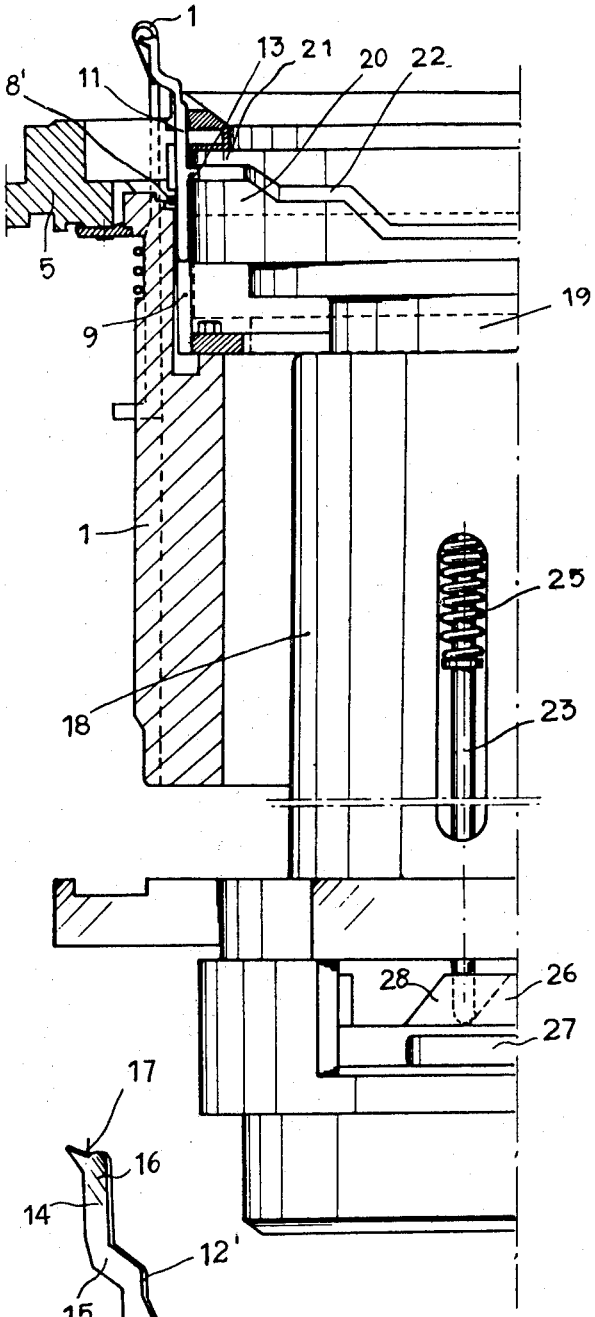
FIG. 4 is a partial sectional elevational view of the assembly of FIG. 2, showing the control means for the pin punches.

Therefore, briefly stated, needles 1 and pin punches 11 are mounted and guided separately on two circumferential concentric lines c and d, as shown in FIG. 1 which correspond to the grooves 2 of the cylinder 3 and, respectively, of the sleeve 8 (see FIG. 3). Conversely, only the upper portions 14, 16, 17 of the pin punches 11 are alternately positioned and aligned circumferentially with respect to the needles 1 (see FIGS. 2–4). In this manner, the punches 11 are vertically movable in the grooves 9 of the sleeve 8 independently of the displacements of needles 1 and are offset timewise with respect to the displacements of the needles 1. The pin punches 11 may be positioned to cooperate with the cylinder 3 or, conversely, they may be depressed whereby they are completely excluded from the knitting operation (this is in the case that a non-terry fabric is desired such as a Vanisé-type fabric).

To control the pin punches 11, inside of and coaxially with sleeve 8, and therefore with respect to the cylinder 1, there is mounted a stationary, tubular sleeve 18 that is rigidly attached to the frame of the machine and which telescopically carries on top thereof, a bushing 19 that is vertically positionable above the tubular sleeve 18 and inside of the sleeve 8 that receives the pin punches 11. On the periphery of the bushing 19 there are fixed annular sectors having cams 20 and countercams 21, which define a cam-like guide path 22 for the butts 13 of the pin punches 11. This guide path 22 has as many sections that lift and as many sections that lower the butts 13 as there are yarn feeding stations in the circular machine. It is to be noted that the cams 20 and the countercams 21 are oriented in juxtaposition with respect to the cams that control the needles 1, so that the pin punches 11 might move upwardly when the needles 1 are in descending phase, that is to say at every working station or phase.

Figure 2:
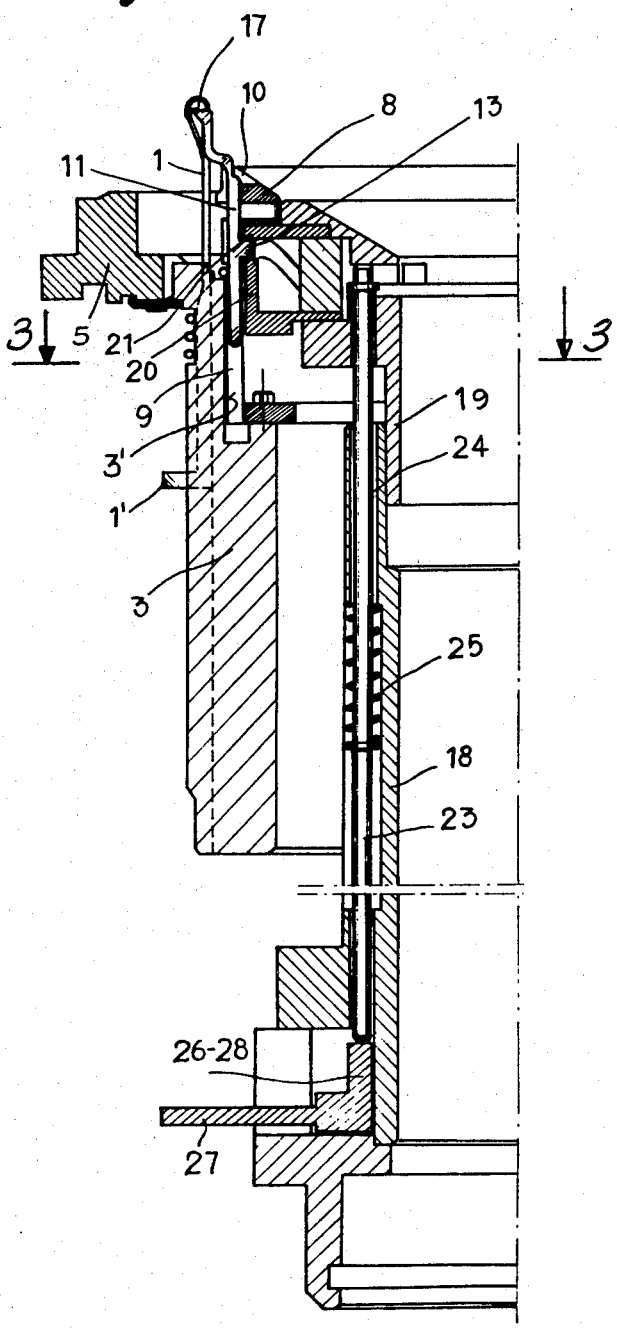
FIG. 2 is a partial longitudinal sectional view of the assembly of a portion of the apparatus of the invention.

As stated above, the pin punches 11 may be activated or de-activated completely, depending on the circumstances. This is done by moving and positioning vertically the bushing 19 with its pin punch controlling cams 20–21 until the pin punches 11 reach a height such as to allow their cooperation with the needles 1 or below the plane where the stitches are knitted. To this effect, the three vertical rods 23 are attached to the bushing 19 and are guided in longitudinal openings 24 provided in the stationary tubular sleeve 18, and actuated by spring 25 that are capable of keeping the rods 23 displaced normally downwardly, to which position corresponds the position of exclusion from work of the pin punches 11. To upwardly displace the bushing 19 and to bring the pin punches 11 on the working plane with the needles 1, a ring 26 is provided at the base of the tubular sleeve 18. The ring 26 is capable of effecting angular movements by means of a lever 27. The ring 26 has a plurality of lifting cams 28 that correspond to and engage the lower extremities of the vertical rods 23, in order to upwardly displace the rods 23 against the force of the springs 25 when the ring 26 is rotated and to position the entire assembly as shown in FIG. 2.

Figure 6:
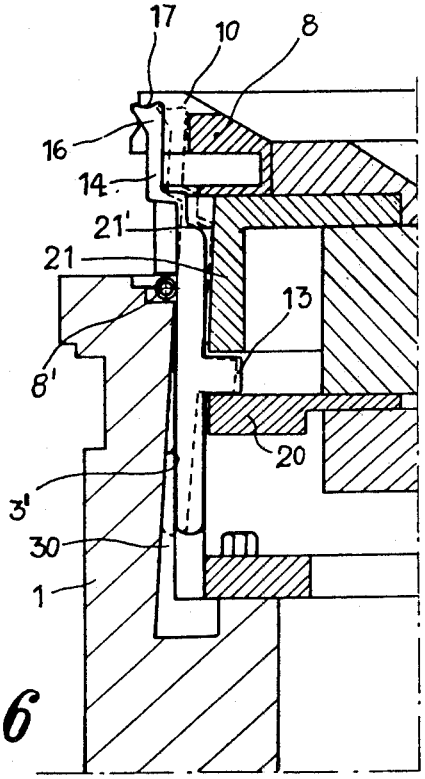
FIG. 6 is an enlarged sectional detailed view of the guiding and control means for the pin punches as well as its rocking movement in the respective groove.

Another feature of the assembly resides in the fact that the pin punches 11 can rock inside their grooves 9 of the sleeve 8, wherein they are held in position by a spring 8' that encircles the sleeve 8 itself. To this end, seat 3' of the cylinder, within which rests the sleeve 8 is tapered or countersunk, that is to say has a diameter increasing from top to bottom, as shown in detail in FIG. 6. In this manner, between the sleeve 8 and the surface of the seat 3' there is a space 30 that permits the oblique positioning of the pin punches 11. This oblique positioning is aided by a step 12' in the upper part of the stem 12 of each pin punch 11 and by a bevel 21' in the peripherial surface of each descent cam 21 of the pin punches 11 as shown in FIG. 6.

Figure 7:
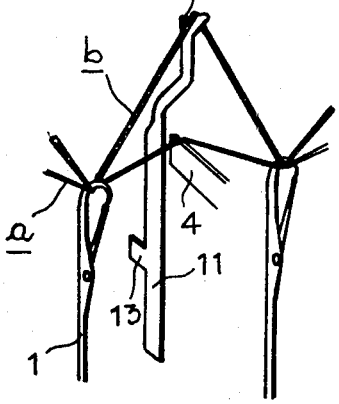
FIG. 7 is a detailed perspective view of the knitting of a terry loop of the fabric.

The knitting of the terry loop fabric by means of the apparatus described hereinabove is effected as follows: While the cylinder 3 (with its needles 1) and the sleeve 8 (with the pin punches 11) associated therewith are rotating together, at least two yarns a and b are brought (together with the needles 1) upwardly (in position to be gathered) by the lifting cams (not shown) which cams are placed in correspondence with each feeding station of the machine. When the needles 1 are depressed or moved downwardly (in position to be dropped) the pin punches 11 which have been previously activated by the ring 26 and the cams 28, are raised by the lifting cams 20 and held there during predetermined angular displacement of the cylinder 3. In this manner, while the needles 1 are depressed the recess 17 of head 16 of the pin punches 11 is raised little by little picking up yarn (a) or (b) and keeping it displaced above the other yarn, as shown in FIG. 7. The terry loops or elongated looped stitches of the terry fabric are thus formed, loops which result as a protrusions from the base fabric in the usual way by the needles 1 in cooperation with the sinkers 4. When the terry loops are combined with the base fabric, the pin punches 11, following the path defined by the countercams or descending cams 21, are depressed or moved downwardly so as to drop the loops and position themselves in readiness for the successive phase of operation. The dropping of the loops by the pin punches 11 occurs in a phase of the work, in which the sinkers 4 move from the outside toward the center, so as to support the stitches in the known, conventional manner. The action of the sinkers 4 on the stitches, to which corresponds a stretching of the knitting toward the center, has the tendency of causing the stitches to adhere to the upper part 14 of the pin punches 11 when the latter are depressed or moved downwardly. This would cause an interference by the pin punches 11 in the correct knitting if the pin punches 11 were not allowed to rock within the grooves 9, as provided by the present invention, so as to eliminate completely such interference. The pin punches 11, in fact, because of the push exerted by sinkers 4 on the stitches and because of the tapering of the seat 30 of the sleeve 8, are positioned obliquely as shown in FIG. 6, so as not to interfere with the stitches previously knitted and to permit the head 16 of the pin punches 11 to correctly drop the loops.

Hence the possibility of obtaining a uniform terry fabric, with a correct positioning of the yarns, since the pin punches 11 pick up and always hold the same yarn or yarns fed, while the other yarn or yarns are employed in knitting the base fabric. The terry fabric is thus knitted with a regular "Vanisé" appearance that affords the fabric a superior and more pleasing effect.

It is to be noted that the same knitting operation is obtained either with the rotation of the cylinder in a unidirectional movement or with a reciprocating rotation of the cylinder in one direction or in the other. The terry fabric may be knitted, as stated above, either on a part or on the entire article, by presetting the pin punches 11 on a portion or on the entire surface of the sleeve 8 which is associated with the cylinder 3.

What is claimed is:

1. Apparatus for knitting terry loops in a fabric on circular hosiery machines with at least one feeding station, comprising a selectively rotatable cylinder having a plurality of axially extending, angularly spaced apart grooves formed therein, a plurality of axially displacable needles individually guided in said grooves, a sinker bed encircling said cylinder, a plurality of radial sinkers carried by said cylinder and cooperating with said needles, means for feeding at least two yarns concurrently to said needles in correspondence with at least one working station, a sleeve positioned in said cylinder, said sleeve having a plurality of longitudinally extending grooves spaced apart angularly over at least a part thereof and a pin punch positioned in an guided by each of said longitudinaly grooves, said pin punches being alternately positioned with said needles of said cylinder, said pin punches each having a butt facing and protruding toward the center of said sleeve and defining a guide path for said butts of said pin punches for the raising and lowering thereof; said pin punches being raised upwardly to form the terry loop of the fabric with at least one of the fed yarns, the needles of the cylinder being lowered to knit the remainder of the fabric, and cam means positionable vertically and arranged to engage said pin punches whereby in one position of said cam means said pin punches are actuated and in another position of said cam means said pin punches are deactivated.

2. Apparatus according to claim 1, wherein said sleeve with said pin punches is positioned in a seat provided in the upper part of the cylinder, said seat being increasingly tapered from top to bottom to define in combination with the outer surface of said sleeve a space that allows rocking movements of said pin punches in their respective grooves, when said pin punches for knitting the base fabric are displaced toward the center of said cylinder.

3. Apparatus according to claim 1 wherein said pin punches are mounted and guided in a circumferential concentrical line displaced toward the inside with respect to the circumferential line on which lie the needles of said cylinder.

4. Apparatus according to claim 1 wherein the longitudinal grooves of said sleeve are aligned with comb-like, radial throats provided in the upper part of said sleeve for guiding said pin punches during knitting of the base fabric.

5. Apparatus according to claim 1 wherein each said pin punch comprises a rectilinear stem having a longitudinal axis, an upper portion displaced outwardly with respect to the longitudinal axis of said stem and integral therewith by means of a transverse, connecting portion, and an upper head having a recess for picking up and holding the yarn forming the loops.

6. Apparatus according to claim 5 wherein said upper head of each of said pin punches is positioned between said needles of said cylinder and is circumferentially aligned with said needles, while said stems of said pin punches are on a line circumferentially concentric with said needles.

7. Apparatus according to claim 5 wherein said sleeve has grooves for guiding said punches, said grooves being provided on the entire circumference of the sleeve.

8. Apparatus according to claim 1 further including cam means for controlling said pin punches, said cam means being mounted on the periphery of a bushing that is concentric with said sleeve that carries said pin punches; said bushing being vertically displaceable and positionable for activating or deactivating said pin punches.

9. Apparatus according to claim 8, wherein said bushing is mounted and guided telescopically on the upper extremity of a tubular member that is coaxial with said cylinder and engaged by spring-loaded vertical rods for the vertical positioning of said bushing, said rods being guided in corresponding longitudinal openings provided on said tubular member and being engaged by a ring having lifting cams which cause the displacement of said rods.

10. Apparatus according to claim 1 wherein said cylinder is of the type adapted for continuous rotation in a single angular direction.

11. Apparatus according to claim 1 wherein said cylinder is of the type adapted for reciprocating angular rotation.

12. Apparatus according to claim 5 wherein said butt is located intermediate said transverse connecting portion and the end of said stem that is remote from said upper head.

* * * * *